US005148592A

United States Patent [19]

Camitz et al.

[11] Patent Number: 5,148,592

[45] Date of Patent: Sep. 22, 1992

[54] METHOD AND APPARATUS FOR HANDLING FLOOR COVERINGS

[75] Inventors: Peter Camitz, Stockholm; Ichi S. Gadelius, Lidingö, both of Sweden

[73] Assignee: Proclino Golv AB, Älvsjö , Sweden

[21] Appl. No.: 623,431

[22] PCT Filed: May 23, 1989

[86] PCT No.: PCT/SE89/00289

§ 371 Date: Jan. 17, 1991

§ 102(e) Date: Jan. 17, 1991

[87] PCT Pub. No.: WO89/12150

PCT Pub. Date: Dec. 14, 1989

[30] Foreign Application Priority Data

May 31, 1988 [SE] Sweden ..... 8802030

[51] Int. Cl.[5] ..... B23P 19/04; E01C 23/08

[52] U.S. Cl. ..... 29/426.4; 29/426.3; 29/558; 299/37

[58] Field of Search ..... 29/412, 426.3, 426.4, 29/240, 265, 558; 156/72; 242/86.5; 299/18, 37, 38, 39, 40

[56] References Cited

U.S. PATENT DOCUMENTS

| | | | |
|---|---|---|---|
| 2,749,103 | 6/1956 | Clemenzi | 299/37 X |
| 2,777,680 | 1/1957 | Robb | 299/37 |
| 2,906,514 | 9/1959 | Becker | 299/37 |
| 3,376,071 | 4/1968 | Stein | 299/37 |
| 3,695,713 | 10/1972 | Rothi et al. | 299/37 |
| 4,394,052 | 7/1983 | Adams et al. | 299/18 |
| 4,640,553 | 2/1987 | Zelenka | 299/40 X |

FOREIGN PATENT DOCUMENTS

| | | |
|---|---|---|
| 2831977 | 2/1979 | Fed. Rep. of Germany . |
| 3002831 | 7/1981 | Fed. Rep. of Germany . |

*Primary Examiner*—Joseph M. Gorski
*Assistant Examiner*—Peter Dungba Vo
*Attorney, Agent, or Firm*—Nies, Kurz, Bergert & Tamburro

[57] ABSTRACT

A method for handling floor covering (2) comprising floor-cover sections provided with a textile outer surface, comprising taking-up the floor-cover sections from a substantially flat support surface (4).

The method is characterized mainly by gripping a floor-cover section (2) automatically in conjunction with taking-up the floor-cover sections, by means of a gripping device (5) forming part of a mobile pick-up unit (1). The gripping device includes needle-like gripping elements which are inserted at least into the outer surface of the floor-cover section, which is lifted from the support surface (4) by the needle-like gripping elements and subsequently released from engagement therewith.

The invention also relates to apparatus for carrying out the method.

10 Claims, 3 Drawing Sheets

1
6
5
6
2
7"
8
7
7'

25
14
22
30
26
21
12
24
22
23
29
28
10
9
27
12
20
16
17
24
13
19
18
18'
11

METHOD AND APPARATUS FOR HANDLING FLOOR COVERINGS

The present invention relates to a method for handling floor coverings of the kind which are laid in sections, and comprises the step of taking-up such sections from underlying support surfaces.

The invention also relates to apparatus for carrying out the method.

The floors, inter alia, of exhibition halls and similar locations are normally covered with floor coverings made up of floor-cover sections, usually square sections, which are laid on the floor contiguously to one another, such as to cover the floor area concerned. The floor-cover sections are normally of the kind used in so-called wall-to-wall floor coverings or like coverings, and the floor area concerned will normally be large. In those cases where the floor covering is changed or rearranged relatively often, the task of taking-up and laying the floor covering takes a very long time to complete when done manually. The task of taking-up and laying such floor coverings is also very demanding. In the case of exhibition halls where different exhibitions are held in close succession, it is often essential that the floor covering can be replaced or rearranged quickly.

The present invention relates to a method and apparatus which will greatly facilitate the task of taking-up floor coverings which are laid in sections, and which will also considerably shorten the time taken herewith.

The invention thus relates to a method for handling floor coverings of the kind which comprise sections that are provided with a textile outer surface, and comprises the step of taking-up such floor-cover sections from a substantially flat underlying support surface.

The method is particularly characterized in that when taking-up said sections, a floor-cover section is gripped automatically by the gripping device of a mobile pick-up machine by inserting needle-like gripping elements mounted on the gripping device into at least said outer surface and lifting said section from said support surface, and thereafter releasing said section from the gripping device.

The invention also relates to apparatus for handling floor coverings which consist of floor-cover sections provided with a textile outer surface, comprising the step of taking-up floor-cover sections from a substantially flat support surface.

The apparatus is particularly characterized by a gripping device which is mounted on a mobile pick-up machine and intended to grip automatically a floor-cover section when taking-up the floor covering, and includes to this end needle-like gripping elements which are intended for insertion into at least said outer surface, and said gripping device being intended to lift at least a part of the gripped floor-cover section and to release said section through release of the gripping elements with said floor-cover section.

The invention will now be described in more detail with reference to embodiments thereof and to the accompanying drawings, in which FIG. 1 illustrates schematically one embodiment of a mobile pick-up machine having a driving and lifting truck part;

Figure 1:
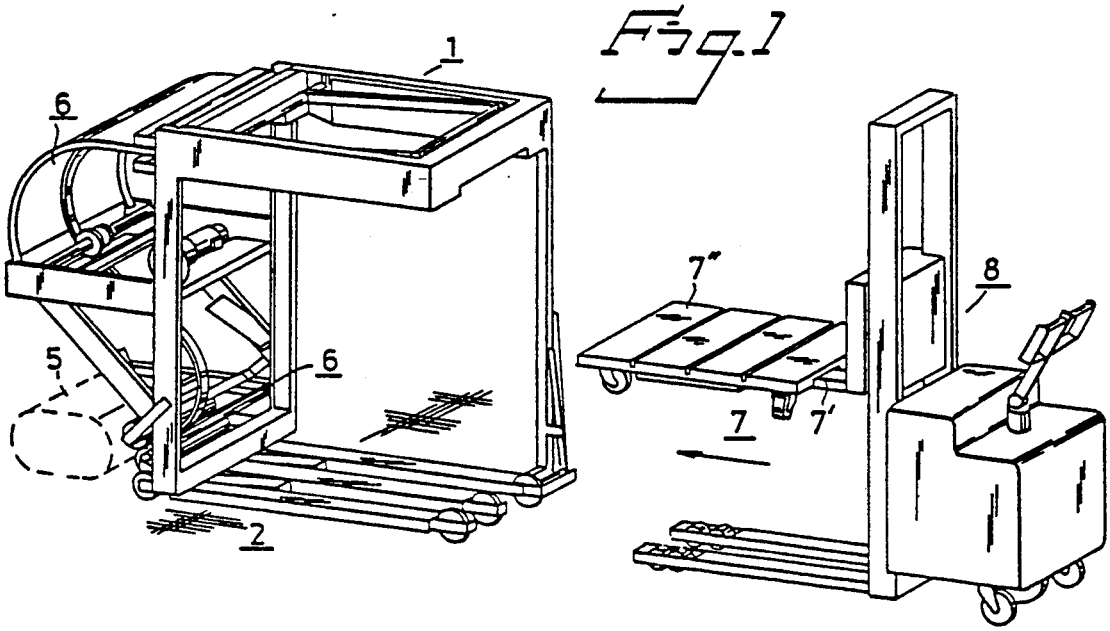
Figure 12:
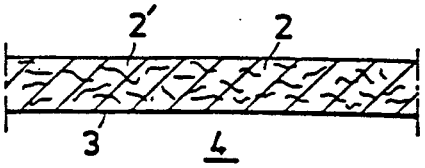
FIG. 12 is a schematic, vertical sectional view of a floor-cover section capable of being taken-up in accordance with the invention.

In FIG. 1 the reference numeral 1 identifies a mobile pick-up machine for automatically taking-up a floor covering 2 comprising floor-cover sections provided with a textile outer surface 2'. The floor-cover sections are normally of the kind used to totally cover a floor surface, e.g. wall-to-wall carpeting, FIG. 12, and are provided with an undersurface 3 which is intended to lie against the surface 4 of the floor concerned. The machine 1 has mounted thereon a gripping device 5, illustrated schematically in broken lines, which is intended to grip at least one floor-cover section and to transfer said section to a feed arrangement 6 incorporated in the machine 1, said feed arrangement being constructed to feed gripped floor-cover sections to a collecting table 7, in the illustrated case a loading-pallet arrangement 7'' carried by lifting forks 7' mounted on a truck unit 8 adapted for driving and lifting adjacent the machine 1.

Figure 2:
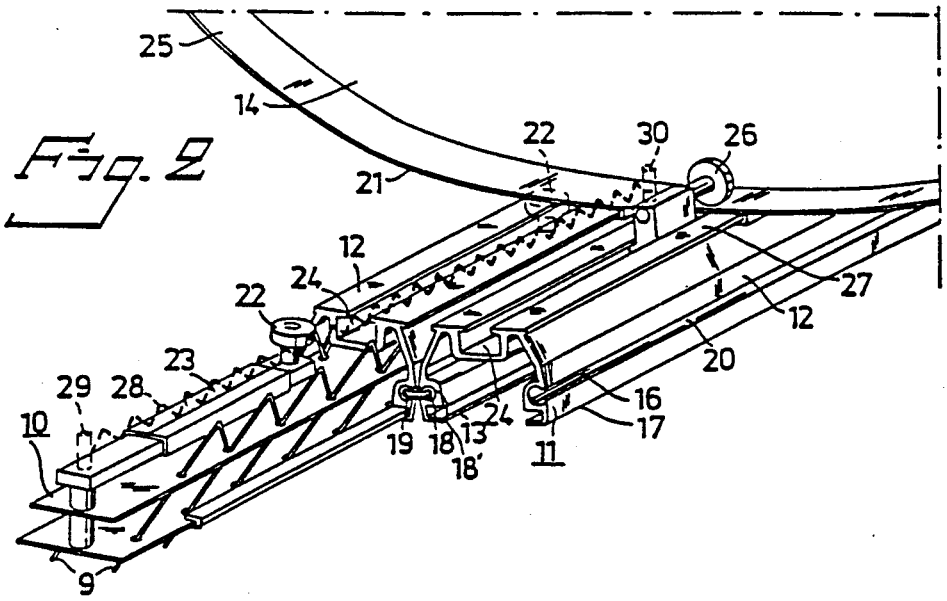
FIG. 2 is a schematic part view of a first embodiment of an inventive gripping device.
Figure 3:
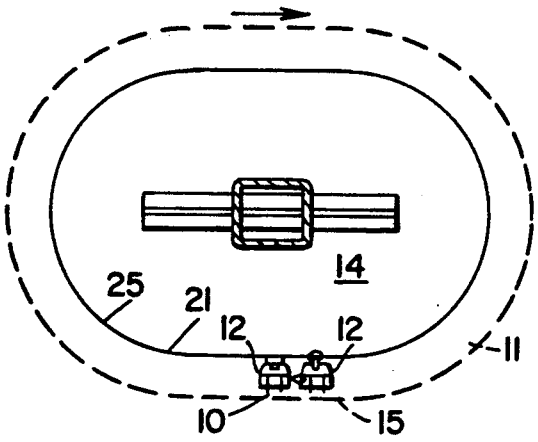
FIG. 3 is a schematic side view of a device substantially according to FIG. 2.
Figure 4:
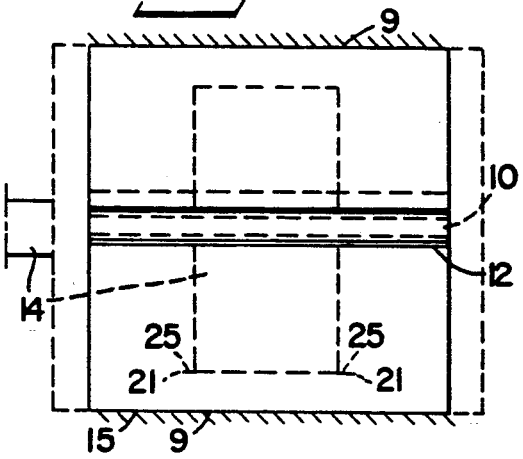
FIG. 4 illustrates the device of FIG. 3 when seen from the left in said figure.
Figure 5:
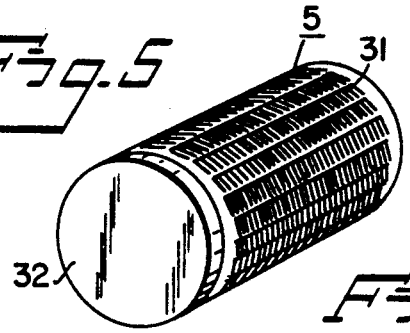
FIG. 5 illustrates schematically a second embodiment of a gripping device according to the invention.

The gripping device 5 of the embodiments illustrated in FIGS. 2–4 comprises needle-like gripping elements 9 which are disposed on carrier bars 10 capable of being displaced in the direction of their longitudinal axes, such axial displacement corresponding to a gripping or a release action. The carrier bars extend substantially transversally to the direction in which the gripping device is intended to be moved.

The gripping elements 9 of this embodiment, and also with the other illustrated embodiments are directed obliquely downwards and are intended to be inserted into a floor-cover section in a direction which forms an acute angle with the main extension frame of the floor-cover section. In this respect, the gripping device 5 is constructed so that when picking-up a floor-cover section, certain first gripping elements will be displaced in a direction which has a predetermined horizontal directional component and such that second certain gripping elements will be displaced in a direction which has a predetermined horizontal directional component of essentially opposite directional sense to the first-mentioned predetermined horizontal directional component when inserting said device, the gripping elements thus coacting in mutually opposite directions when gripping a floor-cover section.

The carrier bars 10 form part of an assembly which comprises a rotatable part 11, or endless belt 11, as described more clearly hereinafter, said part being arranged to roll against the floor-cover section to be gripped, wherein corresponding rotational axes are arranged substantially transversally to the direction in which the gripping device is intended to be moved.

Thus, two kinds of carrier bars 10 are provided, FIG. 3 showing one in which the gripping elements 9 carried thereby are directed in one of said directions having a horizontal direction component opposed to the direction of the other horizontal direction component, said carrier bars being so arranged that said different kinds of carrier bars are displaced in mutually different directions when gripping and releasing a floor-cover section respectively.

The carrier bars 10 are arranged in substantially parallel relationship in respective carrier profiles 12, each of which incorporates a longitudinally extending channel 13 in which a carrier bar is intended to move.

In the case of the illustrated embodiment, the carrier profiles are hinged together sequentially to form said endless belt 11, which is carried for rotation by a carrier device 14. In accordance with the one illustrated embodiment, of FIG. 3 the belt is rotated by being displaced along a non-circular path having an oval shaped vertical section on the carrier device 14, said path having an substantially planar area 15 which faces the support surface and along which said carrier bars of the belt are intended to be in contact with the support surface when advancing the gripping device. According to one illustrated embodiment, the carrier profiles include two longitudinally extending external channels 16, one on each opposite long side 17, each of said channels 16 being intended for co-action with an adjoining channel of a neighbouring profile via a flexible, springy connecting part 18, FIG. 2. In this instance the connecting part 18 comprises a tube 18' or the like of resilient material, such as rubber or plastics, which is inserted into and protrudes from respective channels 16 and is held in said channels by means of a latching rod 19 arranged in the tube and channel, said latching rod in combination together with the tube walls being unable to pass through the channel opening 20 transversely to the longitudinal axis of the carrier profile.

The carrier device 14 includes cam parts 21 for co-action with the carrier bars, such as to achieve desired displacement of said bars when gripping and releasing a floor-cover section respectively. According to the illustrated embodiment, each carrier bar can be displaced longitudinally, by means of a cam part 21, against a spring force, and is returned under the action of said spring force, co-action with said cam part being effected by means of contact devices 22, preferably rotatable contact devices such as the illustrated rollers 22. FIG. 2 illustrates in full lines a position in which the illustrated carrier bar is slightly withdrawn from its carrier profile, for the sake of clarity. Shown in broken lines is a position of the roller 22 in which the roller is in contact with its associated cam part. The roller 22 is mounted on an arm 23 and protrudes from the bar end and the profile end into a groove 24 provided in the profile and facing towards said cam part, wherewith a stop member may be provided at the end of the bar for action against the end of the profile. According to one preferred embodiment, two cam parts 21 are provided, the one being provided for co-action with given carrier bars, such as each alternate carrier bar, and the other being intended for coaction with remaining carrier bars.

In this case, the carrier device includes two flange parts 25 which project out in mutually opposite directions and form the closed path in which the endless belt 11 is intended to move. Each carrier profile 12 is in abutment with said flange parts 25 through the intermediary of a contact part 26, such as a wheel 26 which engages the radially inner surface of one of said flange parts, and through the intermediary of a surface 27 which faces towards said flange parts. Furthermore, each carrier bar 10 is springbiased into abutment with the edge surface of one flange part, by means of a roller 22 or the like, wherewith the belt assembly 11 is floatingly mounted on the carrier device and the edge surfaces of respective flange parts form camming surfaces. The aforesaid spring force can be provided in a number of ways. There is shown schematically one embodiment in which tension springs 28 are mounted between an attachment 29 located at the end of the carrier bars outwardly of said rollers 22 and an attachment 30 located on the carrier profiles spaced from the end of said profiles, such as an attachment 30 mounted on the contact part 26.

FIGS. 5–8 illustrate an embodiment of a gripping device which has a substantially cylindrical configuration and which is intended to roll against floor-cover sections for the purpose of picking-up said sections. The cylindrical gripping device has arranged around its periphery axially extending rows 31 of gripping elements 9 which are raised slightly from the peripheral surface of said device and extend in the circumferential direction thereof. The gripping elements 9 are arranged for rotation about an axis which extends substantially parallel with the cylinder axis of the device and are arranged to be rotated when located substantially at a lowest point adjacent a floor-cover section to be picked-up, at which point the gripping elements are intended to form an acute angle with the main plane of the floor-cover section and where rotation of said gripping elements is intended to take place in a plane which extends substantially at right angles to said axial direction, and where the gripping elements are so arranged in relation to the rotational axis that rotation of said elements causes the pointed part 9' of respective elements to be displaced in the direction in which the gripping device is intended to move, said rotation being intended to drive said pointed part 9' into an underlying floor-cover section.

Figure 6:
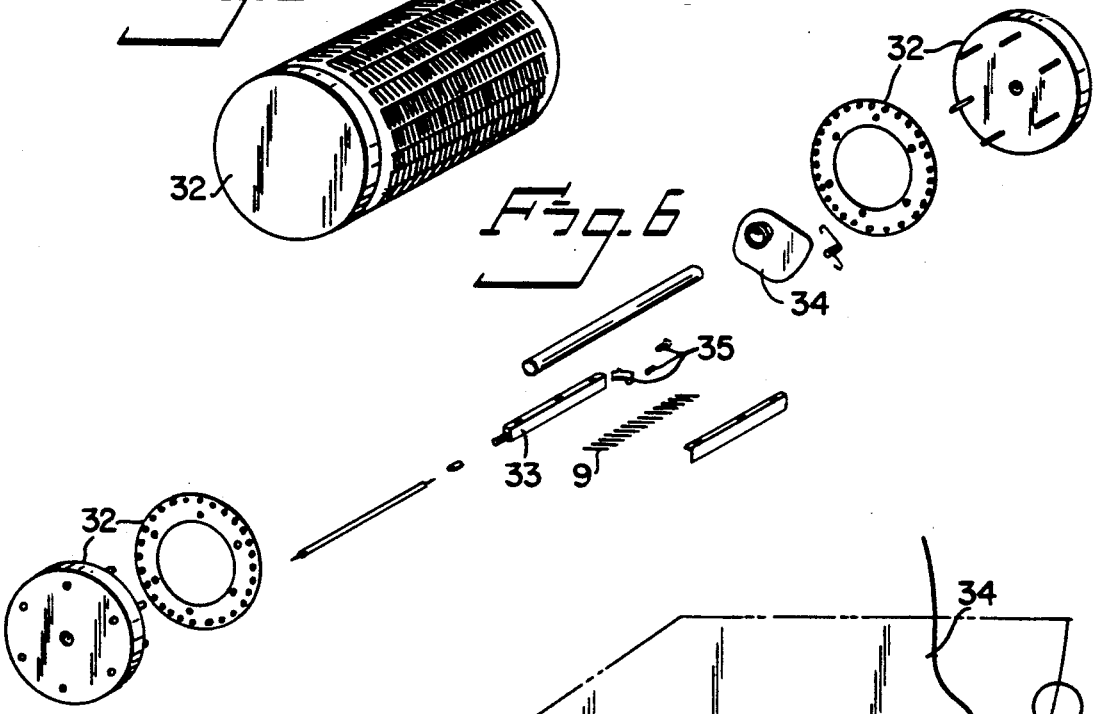
FIG. 6 is an exploded view of a device essentially according to FIG. 5.
Figure 7:
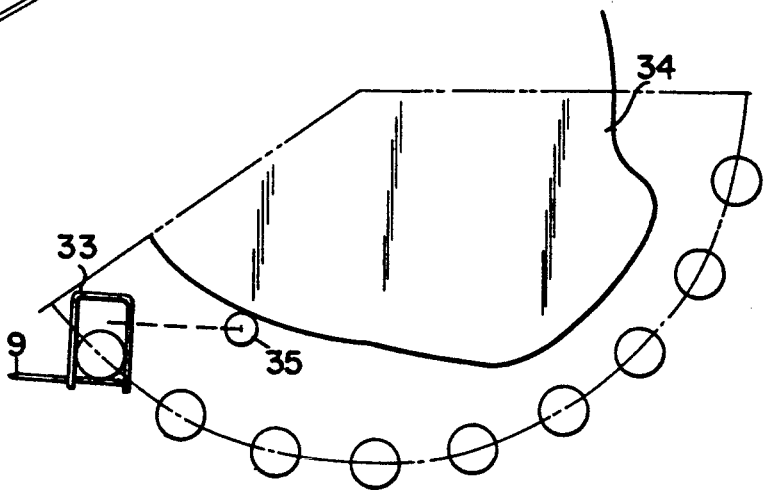
FIG. 7 is a schematic side view of a cam arrangement in a device substantially according to FIGS. 5 and 6.
Figure 8:
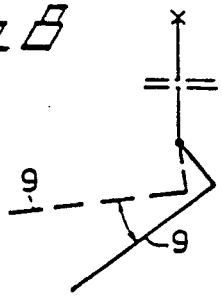
FIG. 8 illustrates schematically different stages of rotation of gripping elements essentially according to FIG. 7, in which rotation is seen in relation to a radial direction.

In this case, the gripping elements 9 are mounted on a rotatable part which includes, inter alia, wheel-like parts 32 intended to roll on the floor-cover sections, and axially extending carrier parts 33 which carry the gripping elements. Attached to the gripping device are cam parts 34 which, via sensing devices 35, co-act with the carrier parts 33 in a manner to cause said rotation. FIG. 6 is an exploded view which illustrates the structural components of the gripping device. FIG. 8 shows an example of the movement produced by rotation of the gripping elements.

Figure 9:
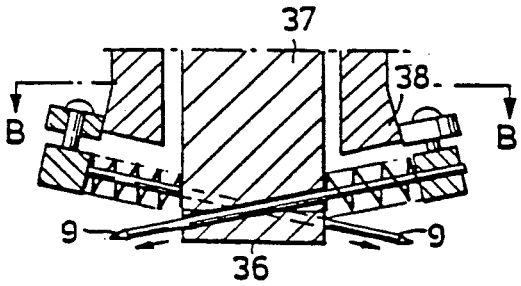
FIG. 9 is a schematic, radial sectional-view taken on the line A—A in FIG. 10, through part of a third embodiment of an inventive gripping device.
Figure 10:
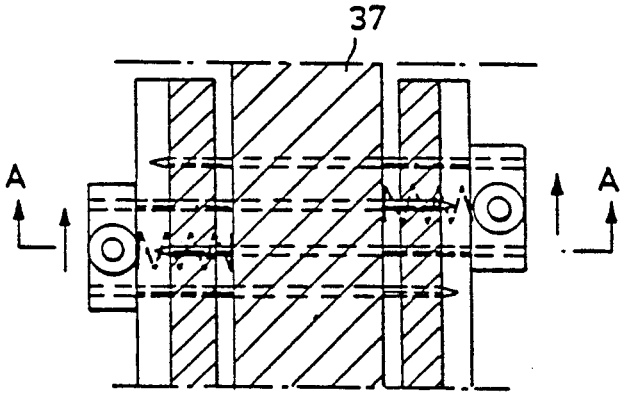
FIG. 10 is a sectional view taken on the line B—B in FIG. 9.
Figure 11:
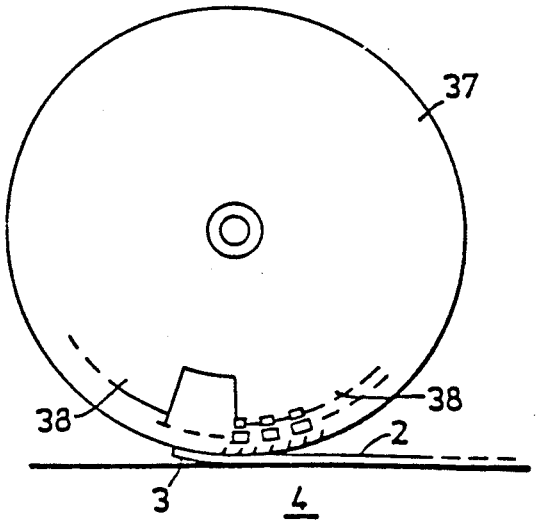
FIG. 11 illustrates schematically a gripping device according to FIGS. 9 and 10, seen from one side.

FIGS. 9–11 illustrate an embodiment of a gripping device in which gripping elements are arranged on the periphery 36 of a substantially circular wheel assembly 37 which is intended to roll on the floor-cover sections. The gripping elements extend transversally to the intended rolling direction, seen axially, substantially in mutually opposite directions and are intended to be inserted forcibly into the floor-cover section in substantially opposite directions. As will best be seen from FIG. 9, the gripping device includes cam parts 38 which are effective in displacing the gripping elements axially in a direction substantially opposite to the direction in which they were forcibly inserted into the floor-cover section, this displacement of the gripping elements being effected against a spring force and preferably in conjunction with releasing a floor-cover section. The forcible axial displacement and insertion of the gripping elements is effected by means of said spring force. The gripping elements of the illustrated embodiment move in and are guided in the wheel assembly, in part.

Although not shown, it is expedient in many cases to mount a plurality of wheel assemblies 37 adjacent one another and with their rotational axes in parallel, such as to form a substantially cylindrical configuration.

The inventive method and the modus operandi of the inventive apparatus will be understood essentially from the aforegoing. Active components thus comprise the gripping elements 9 which are inserted into respective floor-cover sections when picking-up said sections and are withdrawn from said sections when releasing the same.

It will be understood from the aforegoing that the invention enables floor-cover sections to be handled much more rationally than known prior art methods and apparatus.

Although the invention has been described with reference to exemplifying embodiments thereof, it will be understood that other embodiments are conceivable and that minor modifications can be made without departing from the concept of the invention.

Thus, as will be understood from the aforegoing, the floor-cover sections are gripped with the gripping elements located substantially in a lowest level adjacent the floor-cover sections while release of the sections effected subsequent to lifting the gripping elements relative to this lowest position, the gripping device 5 being displaced in the rolling direction between the gripping and release stages. Subsequent to lifting a floor-cover section, a rear edge part of the section, as seen in the direction of movement of the gripping device, is engaged by the feed arrangement 6.

According to one preferred embodiment, displacement of the gripping elements is effected indirectly by driving, displacing, the drive arrangement, e.g. by means of a truck unit, wherein energy is transmitted to the gripping elements 9, inter alia, via friction against at least one floor-cover section on which the gripping device rolls.

The invention should not therefore be considered restricted to the illustrated embodiments, which can be modified within the scope of the following claims.

We claim:

1. A method for handling a floor covering, which covering comprises substantial planar floor-cover sections provided with a textile outer surface, said method comprising: taking-up floor-cover sections from a substantially flat support surface by the steps of moving a gripping device on a mobile pick-up means onto a floor-cover section, causing the gripping device to automatically grip said section by automatic insertion of a plurality of needle-shaped gripping elements, carried by said gripping device, into at least the textile outer surface of said section to be lifted, continuously moving the gripping device by the mobile pick-up means, thereby sequentially lifting the gripped section, moving said lifted section to a new location, and subsequently withdrawing said needle-shaped elements from said outer surface of said lifted section, thereby releasing the gripping of said lifted section from the gripping device.

2. A method according to claim 1, wherein each of the needle-shaped gripping elements are inserted into the textile outer surface of the floor-cover section at an acute angle to the flat surface of the planar floor-cover section.

3. A method according to claim 1, wherein, when said needle-shaped gripping elements are inserted into the textile outer surface of the floor-cover section being lifted, a portion of the plurality of needle-shaped gripping elements are displaced, during insertion, in a direction having a first predetermined horizontal directional component and another portion of the plurality of needle-shaped gripping elements are displaced, during insertion, in a direction having a second predetermined horizontal directional component which is substantially opposite to the first predetermined horizontal directional component, whereby the two portions of the needle-shaped gripping elements mutually co-act by insertion in different directions into the textile outer surface when the gripping device grips and lifts the floor-cover section.

4. A method according to claim 1, wherein the gripping device is mounted on a rotatably arranged part of said mobile pick-up means for rolling on the floor-cover section to be gripped, and wherein the rotational axes extend substantially transversally to the direction in which the gripping device is advanced by said mobile pick-up means.

5. Apparatus for handling floor coverings, which coverings comprise planar shaped floor-cover sections provided with a textile outer surface, the handling comprising taking-up the planar shaped floor-cover sections from a substantially flat support surface, said apparatus comprising: a mobile pick-up means; and a gripping device mounted on and part of said mobile pick-up means and which functions to grip a floor-cover section when taking-up said floor covering, said gripping device including a plurality of needle-shaped gripping elements and operating means adapted to enable insertion of said needle-shaped gripping elements into at least said textile outer surface of said floor-cover surface, and actuating means included on said mobile means and interconnected with said gripping device to lift and move at least a part of the gripped floor-cover section and including further inter-related means to withdraw said needle-shaped gripping elements from said textile outer surface of the lifted and moved floor-cover section whereby floor-cover sections are lifted, moved and subsequently released from the gripping device mounted on the mobile pick-up means.

6. Apparatus according to claim 5, wherein each of said needle-shaped gripping elements are disposed in a longitudinal direction so as to be inserted at an acute angle to the plane textile outer surface of the planar-shaped floor-cover section.

7. Apparatus according to claim 5, wherein said gripping device has a first and a second portion of said plurality of needle-shaped gripping elements and operating means therefor arranged so that when inserted into a floor-cover section said first portion of said needle-shaped gripping elements will be displaced in a direction having a first predetermined horizontal directional component, and said second portion of said needle-shaped gripping elements will be displaced in a direction having a second horizontal directional component which is substantially opposite to the first predetermined horizontal directional component, whereby said first and second portions of gripping elements will coact in mutually opposite directions during said gripping process.

8. Apparatus according to claim 5, wherein said mobile pick-up means and said gripping device include a rotatable means mounting the gripping device on said pick-up means and said rotatable means enables said gripping device to roll on the floor-cover section to be gripped; the rotational axes of the rotatable means being arranged substantially transversally to the direction in which the gripping device is advanced by said mobile pick-up means.

9. Apparatus according to claim 5, wherein said gripping device is constructed, and mounted by said rotatable means, so that operation of the needle-shaped gripping elements for insertion into a floor-cover section is initiated when the gripping device and its gripping elements are located essentially in the lowermost position during rolling of the gripping device on the floor-cover section; and whereby operation to withdraw the thus inserted needle-shaped gripping elements for the purpose of releasing said floor-cover section is initiated subsequent to lifting said section away from said lowermost position; and wherein said gripping device (9) is displaced in the rolling direction between said gripping and release of said floor-cover section.

10. Apparatus according to claim 5, wherein a separate carrier bar is provided to mount each said portion of said needle-shaped gripping elements and means mount said carrier bars on said mobile pick-up means so that the bars extend substantially transversally to the direction in which the mobile pick-up means is intended to be advanced; and whereby said carrier bars are displaceable in their said transverse disposition, the direction of said displacement corresponding respectively to gripping or releasing of a floor-cover section by said needle-shaped gripping elements.

* * * * *